US008376038B2

(12) United States Patent
Hammer

(10) Patent No.: US 8,376,038 B2
(45) Date of Patent: Feb. 19, 2013

(54) SLURRY OUTLET IN A GRAVEL PACKING ASSEMBLY

(75) Inventor: Aaron C. Hammer, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 253 days.

(21) Appl. No.: 12/771,556

(22) Filed: Apr. 30, 2010

(65) Prior Publication Data

US 2011/0266374 A1 Nov. 3, 2011

(51) Int. Cl.
*E21B 43/04* (2006.01)

(52) U.S. Cl. ..... 166/51; 166/222

(58) Field of Classification Search ..... 166/51, 166/222

See application file for complete search history.

(56) References Cited

U.S. PATENT DOCUMENTS 5,636,691 A 6/1997 Hendrickson et al.
5,842,516 A * 12/1998 Jones ..... 166/56
6,491,097 B1 * 12/2002 Oneal et al. ..... 166/278
7,096,946 B2 8/2006 Jasser et al.
7,185,704 B2 3/2007 Bigelow et al.
7,373,989 B2 5/2008 Setterberg
7,559,357 B2 7/2009 Clem
2007/0062686 A1 * 3/2007 Rouse et al. ..... 166/51
2008/0314588 A1 12/2008 Langlais et al.
2009/0255667 A1 10/2009 Clem et al.
2009/0301710 A1 12/2009 Clem et al.

OTHER PUBLICATIONS

Corbett, Gary, et al., "Planning and Execution of Long Horizontal Gravel Packs in Extended Reach Wells", SPE 77520, Sep. 2002, 1-17.

Evans, Brian, et al., "Effect of Acid on Resin Coated Gravel in Prepacked Screens", SPE 39588, Feb. 1998, 1-17.

Kelbie, G.M., et al, "Through-Tubing Inflatable Intervention Tools and Techniques in a Subsea Well Environment", SPE 99360, Apr. 2006, 1-7.

* cited by examiner

*Primary Examiner* — Nicole Coy
(74) *Attorney, Agent, or Firm* — Steve Rosenblatt

(57) ABSTRACT

An outlet member is preferably made from a hardened material and is cut from a tubular shape at an angle of preferably 5 degrees. At its upper end it is cut away so that slurry flow can exit ports in a hardened sleeve and impinge directly onto the upstream portion of the insert. The impingement changes the flow stream angle as the flow continues through a fully tubular middle segment of the insert that leads out to an elongated exit ramp whose downstream end sits preferably flush with the outer housing wall so as to protect the insert from mechanical shocks and retain the insert axially when slurry flows through it. Other external details aid in fixation when in use.

22 Claims, 5 Drawing Sheets

SLURRY OUTLET IN A GRAVEL PACKING ASSEMBLY

FIELD OF THE INVENTION

The field of this invention is completion tools for subterranean use and more particularly those tools used in gravel packing and fracturing subterranean locations and designs to minimize erosion damage from slurries flowing through and entering an annular space around the tool.

BACKGROUND OF THE INVENTION

Well completions that need sand control involve a series of screens with an isolation packer above and a crossover tool that extends through a bore in the packer mandrel that allows gravel slurry to be delivered through the tubing and ultimately into the annular space around the screens as the carrier fluid returns to the surface through the crossover tool and up the outer annulus above the production packer. The path for the delivered gravel slurry is through a first series of ports to get out through the tubing and then into an annular space defined around the tubing by the packer skirt or lower extension assembly. The slurry then exits ports in the packer skirt to get to the annulus around the screens in the producing zone. The erosive nature of the gravel slurry causes excessive wear at the ports both at the tubing and at the packer skirt opening.

Prior efforts at controlling such damage from erosion included placing of hardened inserts in openings in softer metal components to protect the edges of the openings in the softer metal as shown in U.S. Pat. No. 6,491,097. Earlier a hardened sleeve with ports that overlay ports in a weaker surrounding housing were used to prevent erosion of the openings in the surrounding housing as shown in U.S. Pat. No. 5,636,691. Other solutions attempted to configure the flowing stream into a circular or helical pattern to reduce the erosion from impact of slurry that exited ports in a housing. This feature can be seen in U.S. Pat. No. 7,185,704. Other designs used a pivoting baffle plate that responded to slurry flow stream impact to redirect it away from an opposing casing wall as shown in U.S. Pat. No. 7,559,357. Other designs to reduce erosion involved a spinning member that received impact of the slurry flow and was caused to spin to take the energy out of the flowing slurry stream while protecting the housing wall behind the spinning member as described in U.S. Pat. No. 7,096,946. A stationary component with a spiral ridge or projection to induce swirl in the slurry flow is shown in US Publication 20090301710 A1.

Some of the offered designs in the past had moving parts that presented mechanical reliability issues in slurry service. Others put openings in hardened sleeves or hardened inserts directly adjacent to openings in the softer metal housings in an effort to protect the edges of the softer metal by making smaller holes in the hardened sleeve or inserts in the openings in the wall of the softer metal. This also caused resistance to flow so that higher slurry velocities occurred or the drift diameter through the tool was reduced. To avoid the issues with the above described prior designs, the present invention seeks to provide in a design with no moving parts a path for the slurry that redirects its flow direction in the course of spacing apart the soft metal components from the hardened flowpath that reorients the slurry stream. By getting the slurry to travel along the insert in a nearly parallel orientation, the housing walls are protected from any severe erosion as opposed to the prior efforts described above where the slurry exited in intimate contact with the edges of openings in the softer metal of a surrounding housing. Applications for a crossover housing and a subsequent outlet to an annular space around the screens are contemplated. These and other aspects of the present invention will become more readily apparent to those skilled in the art from a review of the description of the preferred embodiment and the associated drawings while appreciating that the full scope of the invention is determined by the appended claims.

SUMMARY OF THE INVENTION

An outlet member is preferably made from a hardened material and is cut from a tubular shape at an angle of preferably 5 degrees. At its upper end it is cut away so that slurry flow can exit ports in a hardened sleeve and impinge directly onto the upstream portion of the insert. The impingement changes the flow stream angle as the flow continues through a fully tubular middle segment of the insert that leads out to an elongated exit ramp whose downstream end sits preferably flush with the outer housing wall so as to protect the insert from mechanical shocks and retain the insert axially when slurry flows through it. Other external details aid in fixation when in use. Applications in a crossover housing and in a surrounding housing before reaching the annulus outside of a screen assembly are contemplated.

DETAILED DESCRIPTION OF THE PREFERRED EMBODIMENT

Figure 1:
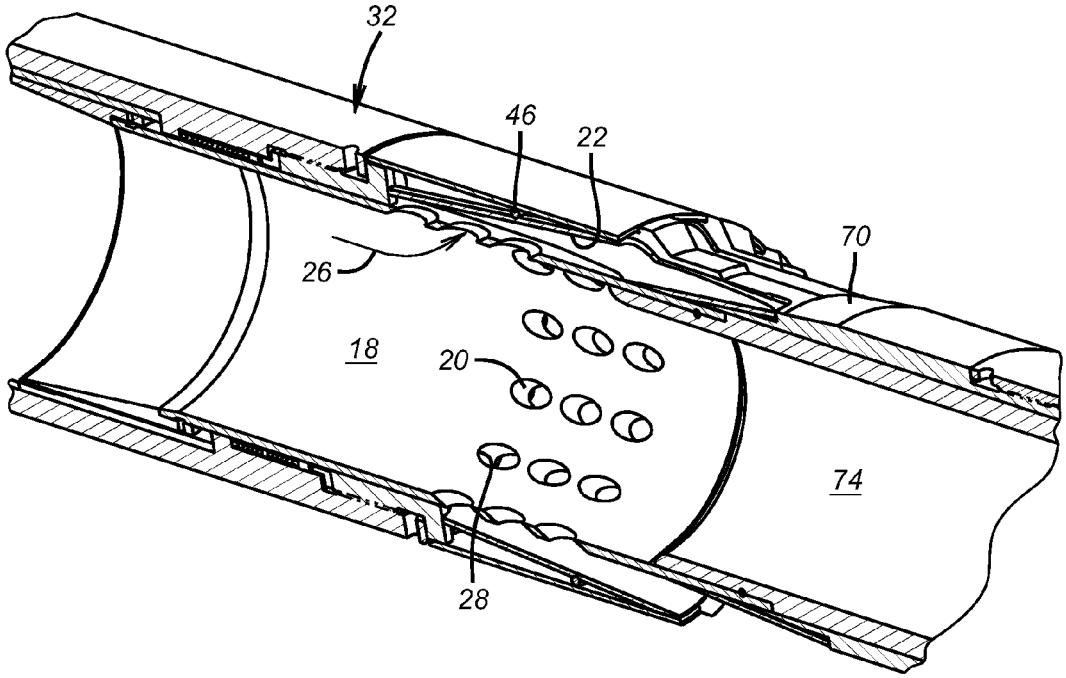
FIG. 1 is a section view of the inserts assembled around a hardened sleeve.
Figure 2:
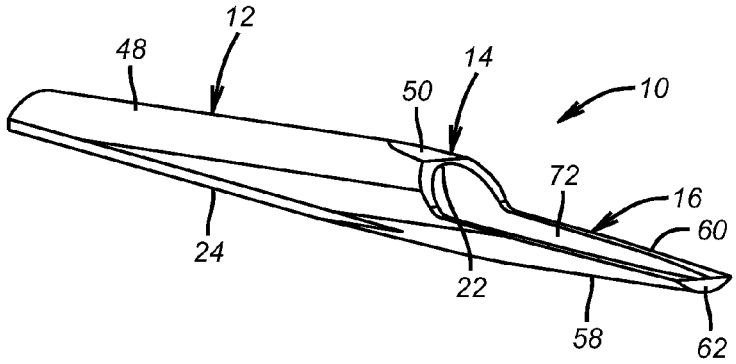
FIG. 2 is a view of a single insert.
Figure 6:
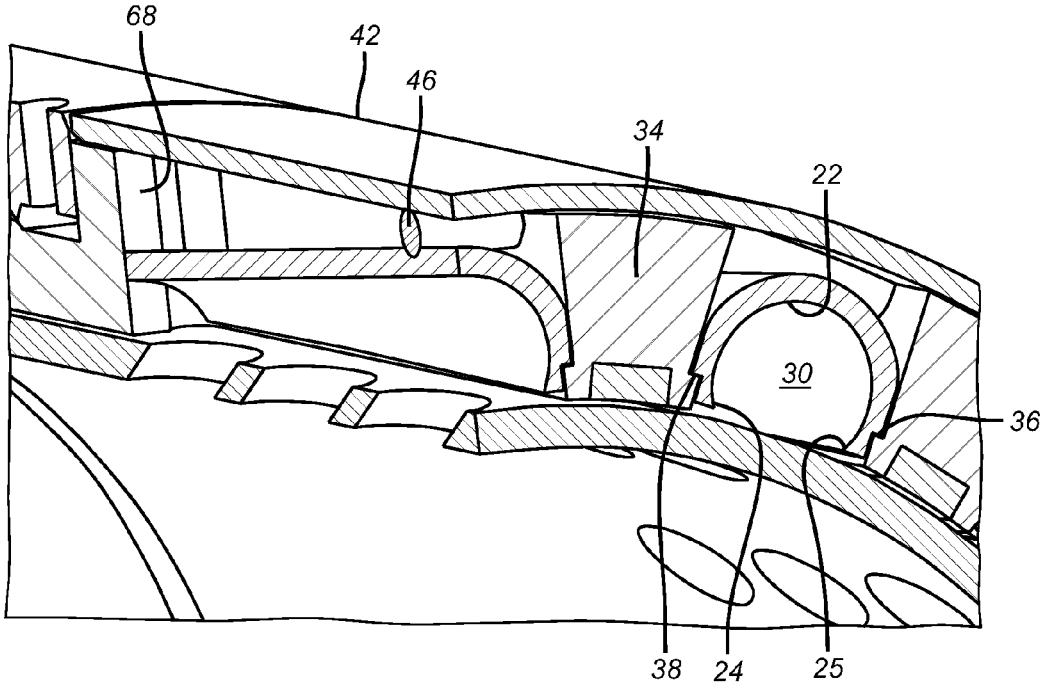
FIG. 6 is a part section close up view of the inlet of the insert showing various fixation devices to hold the inlet in place.

Referring to FIG. 2 the insert 10 has an inlet portion 12 leading to a transition portion 14 and ending with an outlet portion 16. The insert 10 starts as a tubular shape or a block and then is preferably cut into the illustrated shape using wire EDM techniques after sintering the carbide or simply grinding before sintering. It can be one piece or in several pieces. The slant cut is preferably at 5 degrees but a range of angles is contemplated that is controlled primarily by the space available, as seen in FIG. 1, along and below the hardened sleeve 18 that preferably has axial rows of openings 20 that are circumferentially spaced with each insert 10 positioned so that its inlet portion 12, which comprises a portion of the formerly tubular or block shape located in radial juxtaposition to a row of openings or slots or any other shape or shapes 20. The size and mounting angle of the insert 10 is also dependent on the thickness of housing 32. The flowing stream through the insert 10 is preferably on an axis that is no more than 5 degrees from the axis of the housing 32 although other ranges from a few degrees, such as 2 degrees to the slant of the openings or ports 20 is contemplated. In the preferred embodiment the openings 20 in a given row are themselves cut on an axis of about 20 degrees, although a broader range such as about 10-45 degrees is contemplated. Alternatively, the openings 20 can be radial if the inlet portion is made thick enough to withstand nearly perpendicular slurry impact flow. The inlet portion 12 has an arcuate or flat or another shape or shapes inner wall 22 with one of its side edges 24 and 25 visible in FIG. 6 and both inner edges 24 and 25 visible in FIG. 6. If the insert is made from an initial solid rectangular block the profile of wall 22 does not need to be arcuate. It can have other shapes such as flat. While FIG. 6 shows a clearance from edges 24 and 25 to the sleeve 18 to facilitate assembly, a close fit is also envisioned such as a clearance fit or even a small amount of interference. The opposite side edge that is not seen is on an opposite side of a row of openings from edge 24 such that the exiting flow of slurry represented by arrow 26 goes through the rows of openings 20 where the hardened material of the sleeve 18 protects the edges 28 that define the openings 20. The opposed edges 24 and 25 span a row of openings 20 and then by the nature of the angular cut to the original tube or block that formed the insert 10, converge toward each other as the transition portion 14 is reached. While rows of openings 20 are illustrated, elongated slots can be used in the alternative. This is best shown in FIG. 6. However, in the region of the row of holes 20 the opposed edges of the insert 10 at the inlet portion 12 are further apart than the hole dimension so that a passage 30 is defined outside the sleeve 18 as the transition potion 14 is reached, as best seen in FIG. 2.

Figure 3:
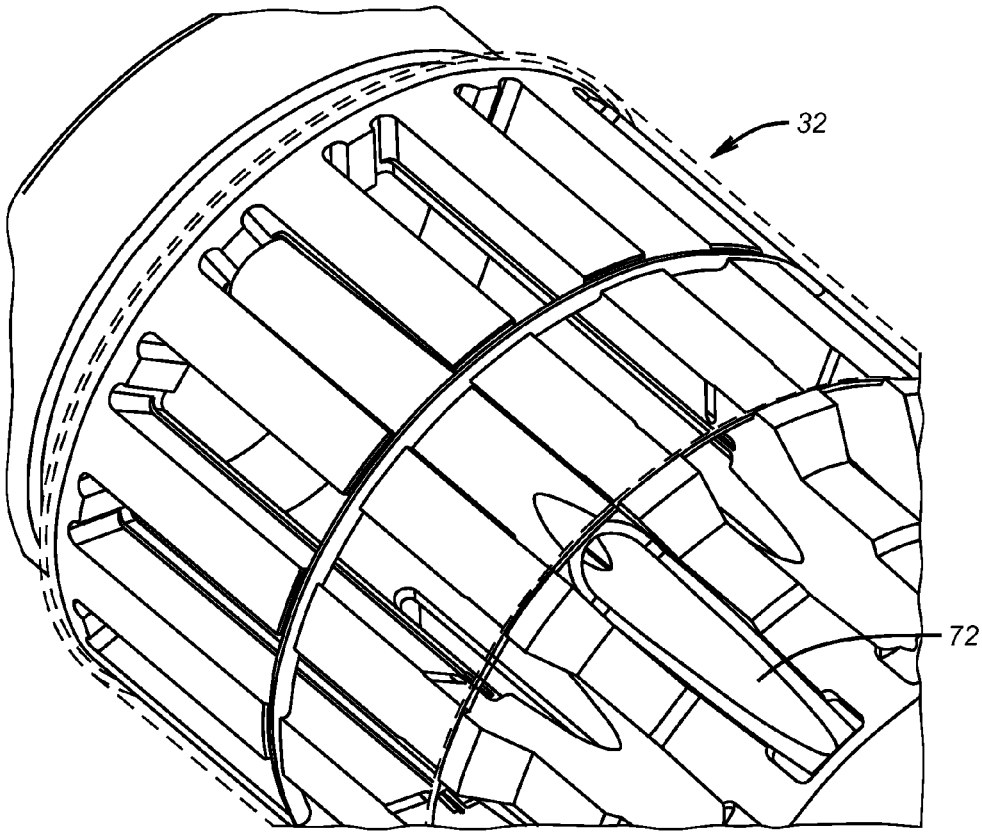
FIG. 3 is an exterior view of a mounted insert under a cover sleeve and extending beyond the cover sleeve.
Figure 7:
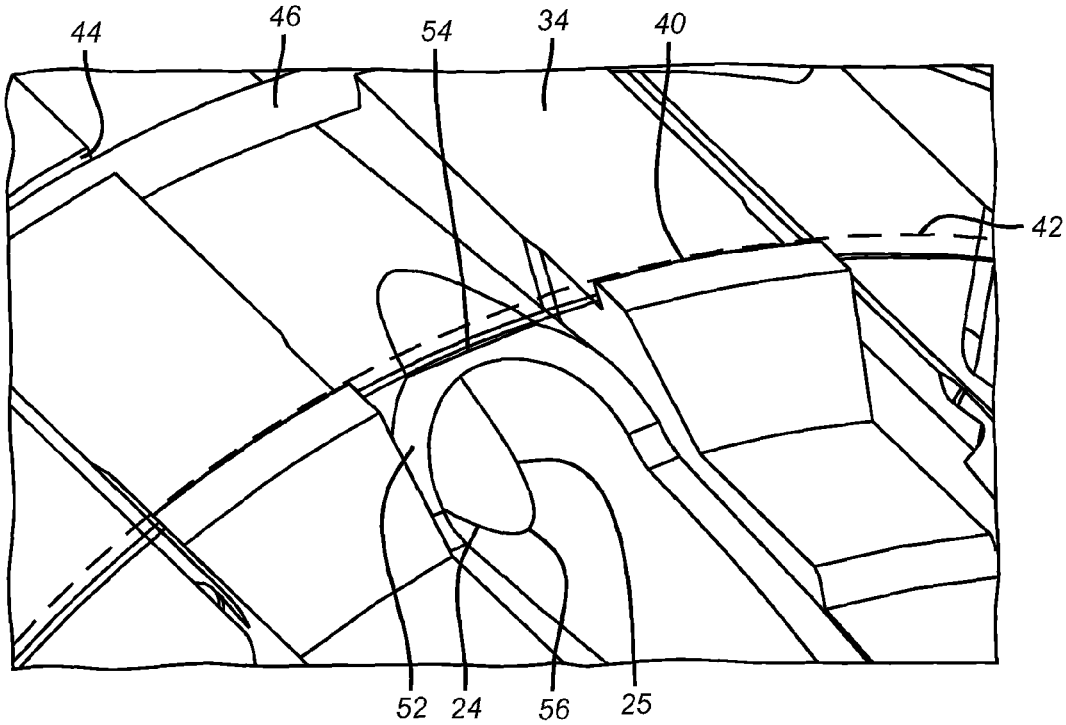
FIG. 7 shows the tubularly shaped transition portion of the insert.

The housing 32 has a series of parallel ribs 34 that are on the outside of the sleeve 18 and located between rows of holes 20. These ribs have lower end shoulders so that a pair of ribs 34 presents spaced locating shoulders 36 and 38 on which the inlet portion 12 is supported. Ribs 34 have an outer ridge 40 to serve as a travel stop for cover sleeve 42. Ribs 34 also have an external groove 44 in which sits an o-ring or clamp, snap ring or other fastener 46 that abuts the outer wall 48 of inlet segment 12. This is best seen in FIGS. 3 and 7.

Slant cut 50 is on the transition portion and it is put there to allow the transition portion 14 to fit up to the inside surface of the cover sleeve 42 as compensation for the slant mounting of the insert with respect to the axis of the housing 32. The transition portion 14 is further defined by a 360 degree structure along a plane defined by the outlet surface 52. The top 54 of surface 52 is preferably located axially even with or below the lower end of sleeve 42 but not further out radially than sleeve 42 so that the exiting slurry flow will not directly impact the sleeve 42 even if there are small eddy streams as the main body of the flow continues toward the outlet portion 16.

Figure 4:
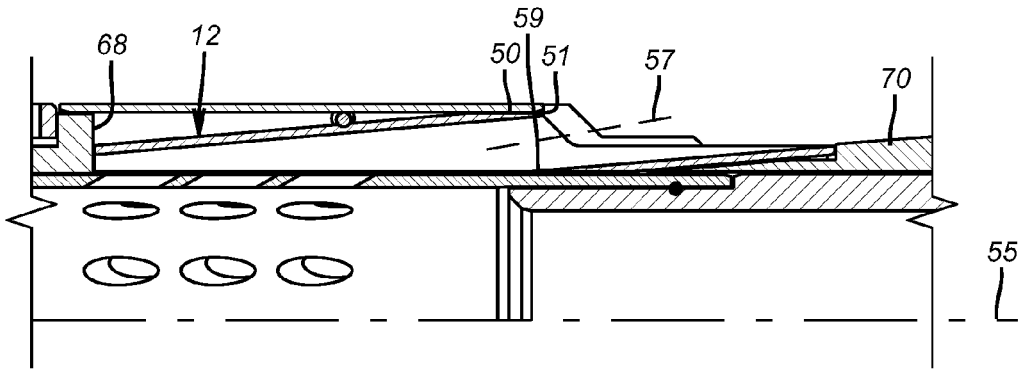
FIG. 4 is a section view from within the hardened sleeve to show the upstream end of the insert.
Figure 5:
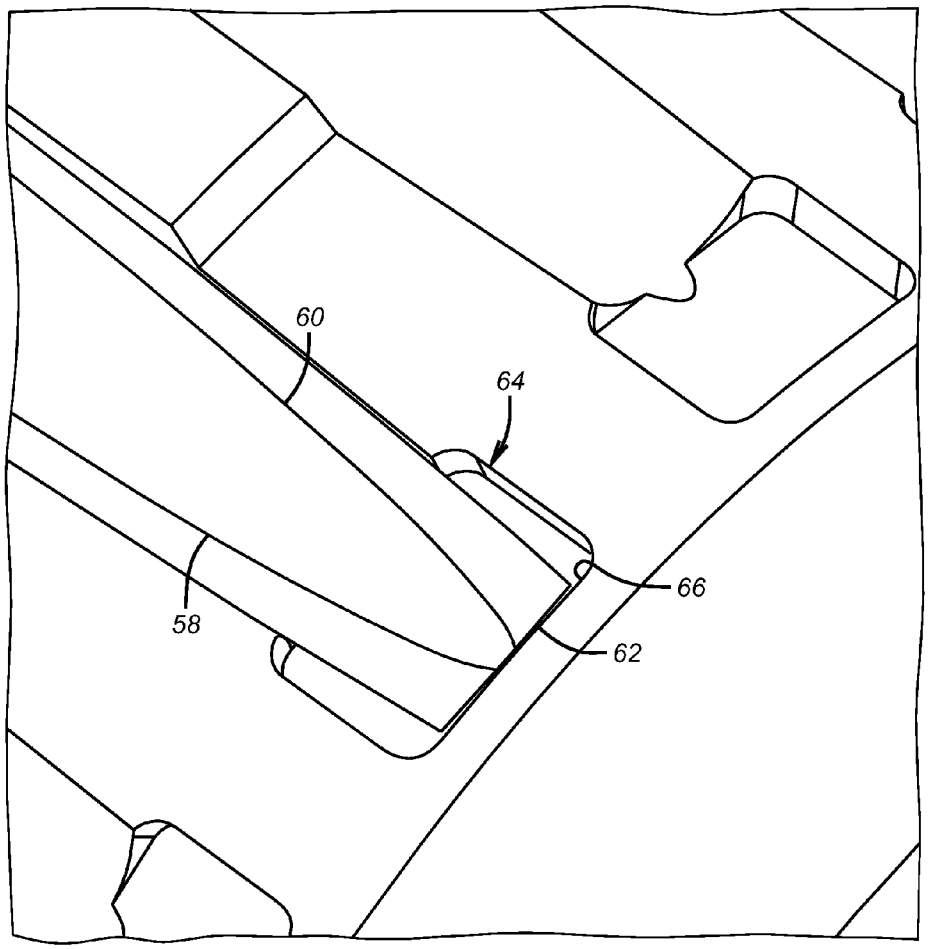
FIG. 5 is an exterior housing view at the discharge end of the insert showing that end protected in a housing recess.

Referring to FIG. 4 it is noted that that lowermost outer location 51 of the transition portion 14 extends radially further from the axis 55 of the assembly than the lower end 53 of the insert 10 outlet 16. With this configuration, the flowing slurry stream has the ability to fan outwardly after passing location 51 so as to lessen the impact on the surrounding tubular or casing while still affording protection to the housing exterior at 70 which is disposed parallel or near parallel to the contact surface 72 on the outlet portion 16 better seen in FIG. 2. The transition portion extends at the lower end to a plane through location 51 that is perpendicular through the flow axis 57. The other end of the transition portion is through location 59 where the insert 10 is closest to the sleeve 18 near the uphole end of the surface 72 and also in a plane perpendicular to axis 57.

Depending on the position of the lowermost opening 20 with respect to the transition 56 of edges 24 and 25 it may or may not be possible for a flow stream to go straight out of the opening defined by surface 52 without making a turn. Preferably, the lowest hole 20 is far enough above the transition 56 so that all flow out of the openings 20 impacts the inlet portion 12 and turns to align with the opening defined by surface 52 at the transition portion 14.

The exit portion 16 continues from transition portion 14 with opposed edges 58 and 60 that end at lower end 62. Lower end 62 is in a recess 64 that has a lower end 66 and acts as a lower travel stop for the insert 10. As seen in FIG. 4, the upper portion 12 is up against vertical flat surface 68 between ribs 34 as also seen in FIG. 6. The o-ring 46 also wedges the upper portion against shoulders 36 and 38 using the cover sleeve 42. It is preferred that the lower end 62 does not protrude radially out of recess 64 to protect it against mechanical shocks but some radial extension is acceptable at lower end 62 since the cover sleeve 42 is close by and has a larger dimension. Cover sleeve 42 is radially smaller than stops 40, below, and some portion of the housing 32, above. Housing 32 has a taper 70 that preferably aligns the taper with the inner curved, flat or some other shape or shapes of wall 72 of the outlet portion 16. What slurry impingement occurs at this location is at such a slight angle that the erosion in that location does not affect the performance of housing 32.

Sleeve 18 has a non-hardened extension sleeve 74 so that the two can be shifted in tandem to close the slurry openings in the housing 32 by positioning the sleeve 74 opposite the ribs 34.

In the preferred application of the insert 10 an array is located around a hardened sleeve 18 which defines an annulus around the exit of a crossover tool for gravel packing. The housing 32 is part of the lower extension sleeve of a packer also not shown but the arrangement of these accessory components is known to those skilled in the art. An array of inserts 10 is disposed under the cover 42 of the housing 32. In another application the array of inserts 10 can be located in wall openings of a crossover housing.

The construction of the insert allows for a gravel or other slurry exit path that avoids impinging softer surrounding surfaces as the insert 10 has an inlet portion 12 that collects the slurry stream exiting hardened openings and defines a hardened path about said openings 20 to funnel the slurry flow through the transition portion 14 where the angle of the flow with respect to the surrounding housing 32 axis is very small and preferably in the range of about 5 degrees but can vary from about 2-20 degrees. While the passage size and housing dimensions can dictate the length of the insert 10 its slope with respect to the housing axis of housing 32 should not exceed the slope of the cut for the openings 20. The slight angular exit from the inserts 10 and the presence of the outlet portion 16 further protects the soft components of housing 32 from impingement of the slurry stream and what impingement there is occurs at such a small angle of contact that even high slurry flows such as 70 barrels per minute, with flow variable depending on the application size, do not create erosion that is of any concern. Thus the outlet from the surrounding housing such as 32 is spaced apart from the openings 20 in the interior structure 18 such that the insert can be shaped to create a flowpath that is resistant to erosion while reorienting the flowing slurry stream. Using the outlet portion 16 the exterior structure such as surface 70 is protected from erosive action because the slight angular exit angle of the insert 10 allows the slurry flow to be nearly parallel to the outer housing so that the impact angle is at a minimum and further directs the slurry into the annulus and down to the region of the gravel screens without significant erosive contact with a surrounding casing when it is a cased hole that is being gravel packed or fractured. When used in an application such as a crossover housing the small exit angle can reduce or eliminate the need for a blast liner in a surrounding housing as the erosive effects will be attenuated or even eliminated. While the preferred application is screen frac packing for sand control, other subterranean applications are contemplated where the flowing stream is capable of erosion.

The preferred material for the insert 10 is tungsten carbide although other hard materials that resist erosion from slurries are contemplated.

The above description is illustrative of the preferred embodiment and many modifications may be made by those skilled in the art without departing from the invention whose scope is to be determined from the literal and equivalent scope of the claims below.

I claim:

1. At least one insert in combination with at least one wall opening in a tubular housing, for gravel packing in a subterranean location, the insert comprising:

an inlet portion comprising an elongated tubular segment having an inlet flow axis where the tubular segment is further cut in the direction of said inlet flow axis to define a flow contact surface that spans over said at least one wall opening while facing said at least one wall opening to define at least in part an inlet passage for flow through said wall opening;

an outlet portion comprising an elongated tubular segment having an outlet flow axis where the tubular segment is further cut in the direction said outlet flow axis to define a flow contact surface facing away from said wall opening said outlet portion connected to said inlet portion by a transition portion; and said transition portion between said inlet and outlet passages having an outermost location that extends radially further from an axis of said tubular housing than a lower end of said outlet portion;

said cuts in the direction of said inlet and outlet flow axes allows the exit angle of said inlet and outlet passages with respect to an axis of the tubular housing to be minimized.

2. The insert of claim 1, wherein:

said inlet portion is a segment of a tubular shape or a solid block.

3. The insert of claim 2, wherein:

said inlet portion is cut in the direction of said inlet flow axis at an angle to the axis of the tubular shape or a solid block.

4. The insert of claim 3, wherein:

said angle of said cut is between 2 and 20 degrees from the axis of the tubular that was cut to form the insert.

5. The insert of claim 1, wherein:

said outlet portion is a segment of a tubular shape or a solid block.

6. The insert of claim 5, wherein:

said outlet portion is truncated cut in the direction said outlet flow axis at an angle to the axis of the tubular shape.

7. The insert of claim 1, wherein:

the insert is formed from a single tubular shape.

8. The insert of claim 1, wherein:

said inlet portion having said contact surface oriented 180 degrees opposite from the orientation of said contact surface on said outlet portion.

9. The insert of claim 8, wherein:

at least one of said inlet and said outlet portion contact surfaces being arcuate or flat or a combination of shapes;

said transition portion comprises a fully tubular section.

10. The insert of claim 9, further comprising:

an inclined surface sloping away from said arcuate surface of said outlet portion and having an upper end extending adjacent an end of a cover sleeve on the tubular housing that overlays said inlet portion.

11. The insert of claim 9, wherein:

said inlet portion of said insert is disposed between two ribs that define an elongated through opening in said housing;

said housing comprises a cover mounted over said inlet portion and supported by said ribs.

12. The insert of claim 11, wherein:

said ribs have a groove to accept a fastener that bears against said inlet portion, said fastener retained by said cover.

13. The insert of claim 11, wherein:

said transition portion comprises a tapered flat next to said inclined sloping surface with said tapered flat aligned with an inside surface of said cover.

14. The insert of claim 9, wherein:

said housing is formed to axially constrain the insert at opposed ends of said insert.

15. The insert of claim 9, wherein:

said arcuate contact surface of said outlet portion at an end of said outlet portion opposite said transition portion extends in part into said housing.

16. The insert of claim 1, wherein:

said tubular housing comprises an internal hardened sleeve having at least one port aligned with said inlet in said inner surface of said housing such that flow through said port impinges said inlet portion.

17. The insert of claim 16, wherein:

said port has an axis oriented at a greater angle to an axis of said housing than said contact surface of said inlet portion.

18. The insert of claim 16, wherein:

said sleeve comprises axial rows of ports or slots circumferentially spaced on said sleeve;

said housing comprises elongated openings aligned with said rows with an inlet portion of an insert in each of said openings such that a plurality of inserts are disposed in said housing to create multiple exit locations for flow therethrough.

19. The insert of claim 18, wherein:

said inlet portion is a segment of a tubular shape or a solid block;

said outlet portion is a segment of a tubular shape or a solid block;

said inlet portion contact surface is oriented 180 degrees opposite from the orientation of said contact surface on said outlet portion.

20. The insert of claim 19, wherein:

said contact surface of said inlet portion extends into contact with said sleeve to define parallel flow passages about said sleeve.

21. The insert of claim 18, wherein:

the insert is formed from a single tubular shape;

said transition portion comprises a fully tubular section.

22. The insert of claim 1, wherein:

the axis of a flowing stream through said insert is not more than 5 degrees from the axis of the tubular housing.

* * * * *